United States Patent [19]

Rosenthal et al.

[11] 4,151,322

[45] * Apr. 24, 1979

[54] PRODUCTION OF FLAME RETARDANT FIBER BLEND HAVING DESIRABLE TEXTILE PROPERTIES COMPRISING POLYESTER AND COTTON FIBERS

[75] Inventors: Arnold J. Rosenthal, Whippany; Alex S. Forschirm, Lake Hiawatha, both of N.J.; Bruce P. Barnes, Charlotte, N.C.

[73] Assignee: Celanese Corporation, New York, N.Y.

[ * ] Notice: The portion of the term of this patent subsequent to Jul. 12, 1994, has been disclaimed.

[21] Appl. No.: 811,743

[22] Filed: Jun. 30, 1977

Related U.S. Application Data

[63] Continuation-in-part of Ser. No. 470,420, May 16, 1974, Pat. No. 4,035,542.

[51] Int. Cl.[2] ..... D03D 1/00; D03D 25/00

[52] U.S. Cl. ..... 428/254; 428/265; 428/253; 428/290; 428/276; 428/921; 260/DIG. 24; 427/222; 427/390 D; 427/401; 264/122

[58] Field of Search ..... 260/9, 47, 47 C, 75 H, 260/860, DIG. 24; 428/224, 921, 253, 254, 264, 265, 276, 272, 290; 264/122; 427/222, 390 D

[56] References Cited

U.S. PATENT DOCUMENTS

| | | | |
|---|---|---|---|
| 3,775,165 | 11/1973 | Young | 428/921 |
| 3,809,681 | 5/1974 | Musser | 260/DIG. 24 |
| 3,870,590 | 3/1975 | Hurwitz | 428/921 |
| 3,873,504 | 3/1975 | Knopka | 428/921 |
| 3,997,699 | 12/1969 | Sistrunk | 428/921 |
| 4,035,542 | 7/1977 | Rosenthal | 428/224 |

*Primary Examiner*—Sam Silverberg
*Attorney, Agent, or Firm*—Kenneth A. Genoni

[57] ABSTRACT

A blend of discrete polyester and cotton fibers comprising a substantial proportion of polyester fibers (i.e., about 50 to 70 percent by weight polyester fibers based upon the total weight of polyester and cotton fibers) effectively is rendered non-burning while retaining the desirable textile properties (e.g., hand and aesthetic appeal) normally associated with this blend. The polyester and cotton fibers are physically admixed with discrete additive fibers formed from a synthetic aromatic polymer containing chlorine, bromine, or mixtures thereof chemically bound to an aromatic ring which is substantially free of an oxide of antimony (as described), and an organophosphorus flame retardant is topically applied to the resulting blend in a minor concentration (i.e., about 2 to 20 percent by weight based upon the total weight of the fibers of polyester, cotton, and synthetic aromatic polymer). Particularly preferred additive fibers are formed from the reaction product of tetrabromobisphenol A, isophthalic acid and terephthalic acid or the ester-forming derivatives thereof. The resulting admixture of fibers preferably is provided in the configuration of a fabric prior to the topical application of the organophosphorus flame retardant.

47 Claims, No Drawings

PRODUCTION OF FLAME RETARDANT FIBER BLEND HAVING DESIRABLE TEXTILE PROPERTIES COMPRISING POLYESTER AND COTTON FIBERS

CROSS-REFERENCE TO RELATED APPLICATION

This is a continuation-in-part of our U.S. Ser. No. 470,420, filed May 16, 1974, entitled "Flame Retardant Fiber Blend Containing Fibers Which If Present Apart From the Admixture Undergo Burning" (now U.S. Pat. No. 4,035,542, granted July 12, 1977).

BACKGROUND OF THE INVENTION

Blends of polyester and cotton fibers are recognized to readily undergo burning and to pose a fire hazard when utilized in fire sensitive environments. The burning propensity of such blends further is recognized to be particularly acute when the polyester component is present in an appreciable proportion of 50 percent or more by weight based upon the total weight of polyester and cotton fibers.

Heretofore, a variety of approaches has been proposed for attempting to deal with the fire hazard posed by a blend of polyester and cotton fibers. Generally these approaches have involved the chemical or physical application of a protective coating (e.g., an organophosphorus flame retardant) upon the surface of the otherwise flammable fibers usually while in fabric form. It commonly has been found essential to apply the protective coating in a major concentration in order to impart the desired self-extinguishing characteristics to the overall polyester and cotton blend particularly when the polyester component comprises an appreciable proportion of the blend. For instance, an organophosphorus flame retardant commonly is applied to such blends in a concentration of about 25 to 40 percent, or more, by weight based upon the total weight of cotton and polyester fibers to pass the Federal flammability standards for children's sleepwear. However, such relatively major concentrations of the flame retardant have a tendency to impair the otherwise desirable textile properties of the blend (e.g., hand and aesthetic appeal). For instance, fabrics formed from a polyester and cotton blend so treated commonly are deficient in comfort and are stiff and harsh. They also commonly exhibit the undesirable quality of poor dyeability (i.e. duller shades), and poor tear strength and abrasion properties. In the prior art fabric constructions and blend levels also have been limited with successful treatments being limited to blends having a high percentage of cotton (e.g., approximately 75 percent by weight) and to medium and heavy weight woven fabric constructions. Shirt weight fabrics of the commonly used 50/50 and 65/35 polyester/cotton blends have not been able to be successfully treated to be self-extinguishing in a vertical test and be durable to 50 home launderings.

Our commonly assigned U.S. Ser. No. 470,420, filed May 16, 1974, entitled "Flame Retardant Fiber Blend Containing Fibers Which If Present Apart From the Admixture Undergo Burning" generically claims a process for rendering normally burning fibers including a blend of polyester and cotton fibers non-burning, as well as the resulting non-burning fiber blend. Included in intimate physical admixture with the fibers which would normally undergo combustion are discrete additive fibers consisting primarily of a chlorinated and/or brominated aromatic polymer having the inherent ability to render the admixture as a whole non-burning when subjected to the flame. Particularly preferred additive fibers are formed primarily of an aromatic polyester formed from the reaction of tetrabromobisphenol A, isophthalic acid, and terephthalic acid or the ester-forming derivatives thereof. Also, in a particularly preferred embodiment a minor concentration of an oxide of antimony (e.g., antimony trioxide or anitmony pentoxide) is intimately dispersed throughout the additive fibers. Flame retardant fiber blends readily may be formed without a diminution of the textile properties thereof, e.g., hand and aesthetic appeal.

It is an object of the present invention to render flame retardant a physical blend of discrete polyester and cotton fibers which contains a substantial portion of polyester fibers.

It is an object of the present invention to provide a flame retardant admixture of discrete polyester and cotton fibers which contains a substantial proportion of polyester fibers having satisfactory textile properties, i.e., hand and aesthetic appeal.

It is an object of the present invention to provide a flame retardant admixture of fibers exhibiting satisfactory textile properties comprising polyester fibers, cotton fibers, and fibers of a synthetic aromatic polymer containing chlorine, bromine, or mixtures thereof chemically bound to an aromatic ring having a chlorine and/or bromine content of about 25 to 60 percent by weight based upon the weight of the aromatic polymer which is substantially free of an oxide of antimony.

It is an object of the present invention to provide a flame retardant admixture of fibers comprising polyester and cotton fibers wherein the polyester fibers are present in a substantial concentration, and an organophosphorus flame retardant is topically applied to the same in a minor concentration thereby retaining the exhibition of desirable textile properties (i.e., hand and aesthetic appeal).

It is another object of the present invention to provide a flame retardant blend of polyester and cotton fibers which exhibits performance characteristics in areas other than burning propensity which are substantially similar to those of an ordinary blend of polyester and cotton fibers.

It is another object of the present invention to render flame retardant to a degree comparable to that achieved in U.S. Ser. No. 470,420, filed May 16, 1974, a polyester and cotton fiber blend which contains polyester fibers in a major proportion without resorting to a relatively high concentration of additive fibers, the presence of an oxide of antimony or otherwise impairing the desirable textile properties of the same.

It is a further object of the present invention to provide a flame retardant fiber admixture which is non-burning (as defined), comprising a substantial proportion of polyester fibers and cotton fibers, when subjected to flame in accordance with the ignition procedure of the Children's Sleepwear Test (i.e., FF 3-71).

It is a further object of the present invention to provide a flame retardant blend of polyester and cotton fibers which yields a garment having improved comfort.

These and other objects, as well as the scope, nature, and utilization of the claimed invention will be apparent from the following description and appended claims.

SUMMARY OF THE INVENTION

A process is provided for rendering flame retardant an admixture of discrete fibers comprising about 50 to 70 percent by weight polyester fibers which comprise at least 85 mole percent polyethylene terephthalate and about 30 to 50 percent by weight cotton fibers consisting essentially of:

(a) intimately blending in physical admixture with said polyester and cotton fibers discrete additive fibers of synthetic aromatic polymer containing chlorine, bromine, or mixtures thereof chemically bound to an aromatic ring having a chlorine and/or bromine content of about 25 to 60 percent by weight based upon the weight of the aromatic polymer in a quantity of about 10 to 40 percent by weight based upon the total weight of the fibers of polyester, cotton and synthetic aromatic polymer, with the fibers of synthetic aromatic polymer being substantially free of an oxide of antimony, and (b) applying a topical application of an organophosphorus flame retardant to the resulting fiber blend in a minor concentration of about 2 to 20 percent by weight based upon the total weight of the fibers of polyester, cotton, and synthetic aromatic polymer wherein the fibers are rendered non-burning when subjected to a methane diffusion flame at ambient conditions and exhibit desirable textile properties.

A flame retardant admixture of discrete fibers is provided possessing desirable textile properties which is non-burning when subjected to a methane diffusion flame at ambient conditions comprising:

(a) about 35 to 55 percent by weight of polyester fibers which comprise at least 85 mole percent polyethylene terephthalate, (b) about 20 to 40 percent by weight of cotton fibers, and (c) about 10 to 40 percent by weight of synthetic aromatic polymer fibers containing chlorine, bromine, or mixtures thereof chemically bound to an aromatic ring having a chlorine and/or bromine content of about 25 to 60 percent by weight based upon the weight of the aromatic polymer which are substantially free of an oxide of antimony, wherein the admixture bears a topically applied organophosphorus flame retardant in a concentration of about 2 to 20 percent by weight based upon the weight of the fiber admixture absent the organophosphorus flame retardant.

DESCRIPTION OF PREFERRED EMBODIMENTS

The present invention may be utilized to render non-burning a physical admixture comprising polyester and cotton fibers wherein the polyester fibers are present in a substantial proportion while retaining the desirable textile properties normally associated with this fiber blend. The well-known fire hazard which is posed by this blend when utilized in fire-sensitive environments accordingly is overcome.

The polyester fiber component which is rendered non-burning comprises at least 85 mole percent polyethylene terephthalate, and preferably is substantially all polyethylene terephthalate. Minor concentrations of comonomer units such as those which are commonly included in polyethylene terephthalate fibers to improve dyeability, e.g., adipic acid, ethylene adipate, ethylene isophthalate, sodium 5-sulfoisophthalate, 3(lithio-4'-sulfophenoxy) -1,2-propanediol, etc. may be present in the normally burning polyester fibers without altering the basic concept of the present invention.

The cotton fiber component which in conjunction with the polyester fibers is rendered non-burning can be any naturally occurring cotton staple. Preferably the cotton fibers are of those lengths commonly selected for use in textile applications, e.g., about 0.25 to 2 inches, and most preferably 0.5 to 1.5 inch.

The polyester fibers are provided in the blend in a substantial concentration. The relative proportion of polyester to cotton fibers which are blended in the present invention is such that there are about 50 to 70 percent by weight polyester fibers and about 30 to 50 percent by weight cotton fibers based on the total weight of polyester and cotton fibers. In a particularly preferred embodiment there are provided about 65 percent by weight polyester fibers and about 35 percent by weight cotton fibers based upon the total weight of polyester and cotton fibers.

The third essential fiber component (i.e., the additive fiber) of the fiber admixture of the present invention is formed of a synthetic aromatic polymer containing chlorine, bromine, or mixtures thereof chemically bound to an aromatic ring having a chlorine and/or bromine content of about 25 to 60 percent by weight (e.g., about 25 to 50 percent by weight) based upon the weight of said halogenated aromatic polymer. Preferred synthetic aromatic polymers are halogenated aromatic polyesters. Particularly satisfactory results are achievable when the halogen substituents upon the aromatic ring are bromine.

Representative additive fibers for use in the present invention consists primarily of a chlorinated and/or brominated aromatic polyester of the recurring structural formula:

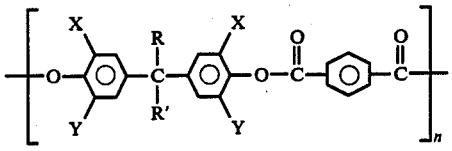

where X is chlorine or bromine, Y is hydrogen, chlorine or bromine, R and R' may be the same or different and represent lower alkyl groups (e.g., 1 to 5 carbon atoms) or hydrogen or together constitute a cyclic hydrocarbon group, and n = at least 25, e.g., about 40 to 400. The end groups of the polymer illustrated in the formula commonly are

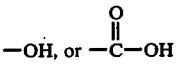

depending upon the synthesis route selected as will be apparent to those skilled in the art. Suitable methods for the manufacture of such aromatic polyesters are disclosed in U.S. Pat. Nos. 2,035,578 and 3,234,167, Australian Patent No. 242,803, British Patent No. 924,607, commonly assigned U.S. Ser. Nos. 351,206, filed April 16, 1973 (now U.S. Pat. No. 3,824,213) and 401,081, filed Sept. 26, 1973 (now abandoned) which are herein incorporated by reference. The chlorinated or brominated aromatic polyester may be formed by the condensation of tetrachlorobisphenol A (i.e., 4,4'-isopropylidene-2,2',6,6'-tetrachlorodiphenol) or tetrabromobisphenol A (i.e., 4,4-isopropylidene-2,2',6,6'-tetrabromodiphenol) with isophthalic acid and/or terephthalic acid or the ester-forming derivatives thereof.

A preferred brominated aromatic polyester is formed by the condensation of tetrabromobisphenol A (i.e., 4,4'-isopropylidene-2,2',6,6'-tetrabromodiphenol) with an aromatic acid mixture of about 45 to 75 percent by weight (e.g., about 60 percent by weight) isophthalic acid and correspondingly about 55 to 25 percent by weight (e.g., 40 percent by weight) terephthalic acid or the ester-forming derivatives thereof (e.g., isophthaloyl chloride and terephthaloyl chloride). For instance, tetrabromobisphenol A may be reacted with a mixture of isophthaloyl chloride and terephthaloyl chloride in the presence of an appropriate solvent and catalyst to produce a polymer having $$-OH \text{ and } -\overset{O}{\overset{\|}{C}}-OH$$

end groups. Such polymers may be spun into the required additive fibers via dry spinning or wet spinning techniques and offer the additional advantage of exhibiting highly satisfactory physical properties following hot drawing which render the same amenable to textile applications, e.g., they possess a good hand and aesthetic appeal.

A preferred chlorinated aromatic polyester is formed by the condensation of tetrachlorobisphenol A (i.e., 4,4'-isopropylidene-2,2',6,6'-tetrachlorodiphenol) with an aromatic acid mixture of about 90 to 40 percent isophthalic acid (e.g., 80 to 60 percent by weight) and correspondingly about 10 to 60 percent by weight terephthalic acid (e.g., 20 to 40 percent by weight) or the ester-forming derivatives thereof. For instance, a lower carboxylic acid diester of a monocarboxylic acid possessing 2 to 5 carbon atoms and tetrachlorobisphenol A may be reacted with a mixture of terephthalic acid and isophthalic acid in the presence of an appropriate solvent and catalyst.

Additional representative additive fibers for use in the present invention are other polyesters, polycarbonates, polyamides or polyurethanes which contain chlorine, bromine, or mixtures thereof chemically bound to an aromatic ring. For instance, monomers such as tetrachlorobisphenol A, tetrabromobisphenol A, 2,5-dichloroterephthalic acid, 2,5-dibromoterephthalic acid, 2,3,5,7-tetrachloroterephthalic acid, and 2,3,5,7-tetrabromoterephthalic acid, di(hydroxy ethoxy ether) of tetrachlorobisphenol A, di(hydroxy ethoxy ether) of tetrabromobisphenol A, diethoxylated 2,5-dichlorohydroquinones, and diethoxylated 2,5-dibromohydroquinones, etc., may supply the chlorine and/or bromine when incorporated in the polymer chain. Those halogenated additive fibers are selected which do not substantially detract from the otherwise desirable textile properties of the normally burnable fibers of the polyester and cotton fibers (e.g., hand and aesthetic appeal), and which have a melting point of at least 180° C. (e.g., a melting point of at least 200° C.).

The halogenated additive fibers are substantially free of an oxide of antimony (e.g., antimony trioxide and antimony pentoxide), and accordingly fiber formation is simplified and may be conducted on a more stable and reliable basis than if a particulate oxide of antimony is to be dispersed within the same such as described in an embodiment of U.S. Ser. No. 470,420, filed May 16, 1974. Accordingly, particles of an oxide of antimony are omitted from the spinning solution from which the additive fibers are formed. Nevertheless, the fiber blends of the present invention are non-burning in spite of the high proportion of polyester fibers and the relatively low proportion of additive fibers.

The polyester fiber component as well as the additive fiber component of the fiber admixture may be provided in any one of a variety of physical configurations, e.g., fluff, sliver, yarns, tows, rovings, fibrids, filaments, etc., and may consist of staple or continuous fibers. Any discontinuous fibers selected commonly have an aspect ratio of at least 100.

The fiber blend or admixture of the present invention may be formed by physically dispersing the separate and distinct additive fibers throughout the normally burnable fibers (i.e., polyester and cotton fibers). The resulting blend or admixture may take the form of a random array of staple fibers suitable for further processing or a highly ordered fiber assemblage, such as a woven or knitted fabric. Within an ordered fabric the discrete fibers of each component of the blend may be intimately admixed within each of the yarns forming the same, or the blend may take the form of substantially homogeneous yarns of each component which are provided in close proximity (e.g., preferably adjoining contact). Alternatively, the blend or admixture may take the form of a non-woven sheet. Suitable apparatus for forming blends of staple fibers include cards, drawframes, twisters, webbing machines, flockers, random pneumatic webbers, or other devices for plying filaments or blending staple.

As described, the polyester, cotton, and additive fibers are intimately blended in any convenient manner to form a resulting blend consisting essentially of (a) about 35 to 55 percent by weight (perferably about 40 to 50 percent by weight) of polyester fibers which comprise at least 85 mole percent of polyethylene terephthalate; (b) about 20 to 40 percent by weight (preferably about 25 to 35 percent by weight) of cotton fibers, and (c) about 10 to 40 percent by weight (preferably about 15 to 20 percent by weight) of synthetic aromatic polymer fibers containing chlorine, bromine, or mixtures thereof chemically bound to an aromatic ring having a chlorine and/or bromine content of about 25 to 60 percent by weight of said aromatic polymer. Minor proportions of other fibers additionally may be present which do not materially alter the burning characteristics of the three essential components of the blend or impair its desirable textile properties.

Following formation of the physical admixture of fibers heretofore described an organophosphorus flame retardant is applied in a minor concentration of about 2 to 20 percent by weight (preferably about 6 to 16 percent by weight) based upon the total weight of fibers of polyester, cotton, and synthetic aromatic polymer. Any application technique known to those skilled in the art whereby an organophosphorus flame retardant is applied to fibers, may be utilized (e.g., padding).

The organophosphorus flame retardant which is selected for use in the present process preferably is relatively durable and is not removed to any substantial degree by laundering. Those organophosphorus flame retardants which have heretofore been utilized to flame retard cotton fibers may be utilized. The present process, however, enables the application of the organophosphorus flame retardant to the resulting fiber blend in a lesser concentration than has heretofore commonly been practiced thereby retaining desirable textile properties, and not substantially altering the hand of the blend.

Representative classes of organophosphorous flame retardants include phosphates, phosphites, phosphonates, phosphonium salts, etc.

Representative organophosphate flame retardants for use in the process include: triphenylphosphate; tricresylphosphate; Fyrol CEF flame retardant [i.e., tris (betachloroethyl)phosphate]; Fyrol FR2 flame retardant [i.e., tris (dichloropropyl)phosphate]; tributyl phosphate; tributoxyethylphosphate; cresyldiphenylphosphate; 2-ethylhexyldiphenyl-phosphate; Flexol TOF flame retardant [i.e., tris (2-ethylhexyl)phosphate]; poly (m-phenylenephenylphosphate), etc.

Representative organophosphite flame retardants for use in the present process include: diphenyldecylphosphite; phenyldidecylphosphite; tridecylphosphite; tri(2-ethylhexyl)phosphite; trimethylphosphite; triphenylphosphite, tri(isodecyl)phosphite; distearylpentaerythrityldiphosphite, etc.

Representative organophosphonate flame retardants for use in the process include: vinyl phosphonate of the structural formula

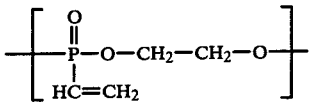

which is commercially available from the Stauffer Chemical Company under the designation "Fyrol 76"; poly(m-phenylene phenylphosphonate); poly (4,4'-oxyphenylenesulfone phenylphosphonate); poly (m-phenylene chloromethylphosphonate); etc. The polyphosphonates are the preferred organophosphorus flame retardants for use in the present invention.

Representative organophosphonium salt flame retardants for use in the present process include: tetrakis hydroxymethyl phosphonium sulfate which is commercially available from the Hooker Chemical Co. under the designation "Pyroset TKO"; tetrakis hydroxy phosphonium chloride which was commercially available from the Hooker Chemical Co. under the designation "THPC" (i.e., tetrakis hydroxymethyl phosphonium chloride); etc.

The organophosphorus flame retardant is applied to the resulting fiber blend by contacting the fibers with a solution or dispersion of the flame retardant in accordance with known procedures in a manner such that the desired pickup is accomplished. As will be apparent to those skilled in the art the organophosphorus flame retardant has a tendency preferentially to adhere to the cotton fiber component of the blend. The organophosphorus flame retardant can be dissolved in a suitable solvent or dispersed in a water emulsion. The fiber blend can be contacted with the liquid, dried, and heated as necessary.

In a preferred embodiment of the process the resulting fiber blend is formed into a fabric prior to the application of the organophosphorus flame retardant. For instance, the fabric may be formed by conventional weaving, knitting, felting, etc. Also, the organophosphorus flame retardant is applied simultaneously with a permanent press finish.

In order to test whether a given fiber admixture is "non-burning when subjected to a methane diffusion flame" a knitted or woven sample of the same having a longest dimension of 10 inches may be mounted and ignited in accordance with the ignition procedure of the Children's Sleepwear Test, i.e., FF 3-71. The fibers undergoing testing conveniently may be knitted to form a specimen having a fabric weight of about 0.5 to 10 ounces per square yard, e.g., 3 to 8 ounces per square yard. More specifically, a methane diffusion flame having a length of 1½ inches is caused to impinge upon the bottom edge of the specimen for 3 seconds and is then removed while the specimen is mounted in a cabinet containing air at ambient conditions. The specimen includes a 3/16 inch seam and is provided in a fixed vertical position in a holder as a flat double layer. The methane is supplied to the burner at 2½ psig. For the purpose of the present invention if the specimen is consumed by combustion within the flame or continues to burn in excess of 30 seconds after the flame is removed, then the fibers undergoing testing are considered to burn (i.e., to undergo burning) and to have failed the test. In a preferred embodiment of the invention the specimen is not consumed by combustion within the flame and does not burn in excess of 10 seconds after the flame is removed. The relative size of the resulting char length observable on the specimen also may be utilized as a measure of the flame resistance of the sample. The shorter the char length the greater the flame resistance.

The resulting blend may be utilized in both textile and non-textile applications. For instance, apparel textiles, wall coverings, hospital cubicle draperies, upholstery, thread, etc. may be formed from the same.

The fiber admixture of the present invention is particularly suited for use in those applications where good fabric performance and aesthetics (i.e., desirable textile properties) are of importance in addition to good flame retardance. For instance, the fabric performance of the fiber blends of the present invention have been found generally to be comparable to those of conventional polyester/cotton fiber blends, with the exception that the blends of the present invention may be slightly fuller. The fiber blends of the present invention are unlike the blends achieved if one were able in some instances to impart a comparable degree of flame retardance to a cotton and polyester blend through the application of 25 to 40 percent, or more, by weight of a flame retardant finish. Such blends while exhibiting satisfactory flame retardance would be deficient in the areas of performance and aesthetics.

The following examples are given as specific illustrations of the claimed invention. It should be understood, however, that the invention is not limited to the specific details set forth in the examples.

EXAMPLE I 201.7 parts by weight tetrabromobisphenol A, 46.0 parts by weight isophthaloyl chloride and 30.8 parts by weight of terephthaloyl chloride are reacted to form a brominated aromatic polyester in the presence of about 2600 parts by weight methylene chloride solvent and 82 parts by weight of triethylamine acid acceptor.

The contents of the reaction zone are heated at about 40° C. with agitation for 3 hours. When the reaction is complete triethylamine is extracted with a 3 percent hydrochloric acid solution and the reaction mixture is washed with water until a pH of 6 is achieved. The resulting brominated polyester is recovered by precipitation with methanol. The brominated aromatic polyester has the appearance of a white, fibrous flake and possesses the structural formula heretofore illustrated where X and Y are bromine groups, R and R′ methyl groups, and n = about 50. The brominated aromatic polyester has a bromine content of about 48 percent by weight, a melting point of about 265° C., and exhibits an inherent viscosity of about 0.75 deciliters per gram determined at a concentration of 0.1 percent by weight in a solvent which is a mixture of 10 parts by weight of phenol and 7 parts by weight trichlorophenol.

100 parts by weight of the brominated aromatic polyester are dissolved in 300 parts by weight of a methylene chloride spinning solvent. The solution is filtered and deaerated and extruded through a tantalum spinneret having 20 circular holes of 44 microns diameter each. The as-spun filamentary material is passed into an air chamber provided at 70° C. which flows concurrently and wherein the filamentary material is completely solidified and subsequently is taken up at a rate of 200 meters per minute.

The filamentary material next is hot drawn at a draw ratio of about 4:1 by contact with a 12 inch hot shoe provided at about 325° C.

The drawn filamentary material is crimped by passage through a steam stuffer box and cut into 1½ inch lengths which are free of an oxide of antimony.

40 parts by weight of drawn crimped polyethylene terephthalate fibers having a fiber length of about 1.5 inch, 35 parts by weight of peeler cotton staple having a fiber length of about 1.5 inch, and 25 parts by weight of the crimped brominated aromatic polyester fibers are carded to form a uniform physical admixture of fibers.

The blend next is provided in fabric form by knitting a yarn of the same to form a hoseleg having a weight of 6 ounces per square yard.

A solution of triphenylphosphate was prepared by dissolving in a methanol solvent in a concentration of 25 percent by weight based upon the total weight of the solution. The hoseleg was dipped in the triphenylphosphate solution while provided at room temperature (i.e., approximately 21° C.). The hoseleg was air dried at ambient conditions for about 30 minutes, and subsequently was dried in a circulating air oven provided at 105° C. for about 10 minutes prior to testing. The triphenylphosphate was topically applied to the hoseleg in a concentration of about 4.6 percent by weight based upon the weight of the fiber admixture (i.e., the hoseleg).

The hoseleg was subjected to a 1½ inch methane diffusion flame in air at ambient conditions for three seconds as described in the mounting and ignition description of the standard Children's Sleepwear Test, i.e., FF 3-71, and it is found that the blend is non-burning. More specifically, it is found that the fabric extinguishes in an average time of three seconds after the flame is removed and there are no burning drops. The average char length is 1.4 inch. Also, when the blend was subjected to an ordinary match flame for 3 seconds at ambient conditions as heretofore described it was non-burning. The presence of the brominated aromatic polyester in combination with the organophosphorus flame retardant renders the entire blend non-burning while retaining desirable textile properties (e.g., hand and aesthetic appeal).

For comparative purposes Example I was repeated with the exception that no organophosphorus flame retardant was applied to the hoseleg formed of the three fiber components prior to testing in the methane diffusion flame. It was found that the ten inch sample burned its entire length and was consumed by flame and had an average burn time of 15 seconds.

For comparative purposes Example I was repeated with the exception that the hoseleg was formed solely of 65 parts by weight polyethylene terephthalate fibers, and 35 parts by weight of peeler cotton staple. Also, no organophosphorus flame retardant was applied prior to testing in the methane diffusion flame. It was found that the ten inch sample burned its entire length and was consumed by flame and had an average burn time of 57 seconds.

For comparative purposes Example I was repeated with the exception that the hoseleg was formed solely of 65 parts by weight polyethylene terephthalate fibers and 35 parts by weight of peeler cotton staple. The triphenylphosphate was topically applied in a greater concentration of about 10 percent by weight based upon the weight of the fiber admixture (i.e., the hoseleg) prior to testing in the methane diffusion flame. It was found that the 10 inch sample burned its entire length and was consumed by flame and had an average burn time of 32 seconds.

EXAMPLE II

Example I was substantially repeated with the exception that the triphenylphosphate was applied in greater concentration of about 11.5 percent by weight based upon the weight of the fiber admixture (i.e., the hoseleg). It was found that the ten inch sample had an average char length of 1 inch and an average burn time of 3 seconds.

EXAMPLE III

Example I was substantially repeated with the exception that the triphenylphosphate was applied in an even greater concentration of about 14.1 percent by weight based upon the weight of the fiber admixture (i.e., the hoseleg). It was found that the 10 inch sample had an average char length of 2 inches and an average burn time of 5 seconds.

EXAMPLE IV

Example I was substantially repeated with the exception that the fiber blend from which the hoseleg was formed comprised 50 parts by weight of drawn crimped polyethylene terephthalate fibers having a fiber length of about 1.5 inch, 25 parts by weight peeler cotton staple having a fiber length of about 1.5 inch, and 25 parts by weight of the brominated aromatic polyester fibers. Also, the triphenylphosphate was applied to the hoseleg in a greater concentration of about 15 percent by weight based upon the weight of the fiber admixture (i.e., the hoseleg). It was found that the 10 inch sample had a char length of 0.5 inch, and an average burn time of 0.5 second.

For comparative purposes Example IV was repeated with the exception that no organophosphorus flame retardant was applied to the hoseleg prior to testing in the methane diffusion flame. It was found that the 10 inch sample burned its entire length and was consumed by flame and had an average burn time of 43 seconds.

For comparative purposes Example IV was repeated with the exception that 5.5 percent by weight of antimony trioxide was dispersed in the fibers of the brominated aromatic polyester, and no organophosphorus flame retardant was applied to the hoseleg prior to testing in the methane diffusion flame. The particulate antimony trioxide was dispersed in the methylene chloride spinning solution at the time of spinning. It was found that the sample had an average char length of 1 inch, and an average burn time of 3.4 seconds.

For comparative purposes Example IV was repeated with the exception that the hoseleg was formed solely of 75 parts by weight polyethylene terephthalate fibers and 25 parts by weight of peeler cotton staple. The triphenylphosphate was topically applied in a concentration of 18.1 percent by weight based upon the weight of the fiber admixture (i.e., the hoseleg) absent the organophosphorus flame retardant prior to testing in the methane diffusion flame. It was found that the 10 inch sample burned its entire length and was consumed by flame and had an average burn time of 85 seconds.

For comparative purposes Example IV was repeated with the exception that the hoseleg was formed solely of 75 parts by weight polyethylene terephthalate fibers and 25 parts by weight of peeler cotton staple. No organophosphorus flame retardant was applied. It was found that the 10 inch sample burned its entire length and was consumed by flame and had an average burn time of 50 seconds.

EXAMPLE V

Example I substantially was repeated with the exceptions indicated.

50 parts by weight of drawn crimped polyethylene terephthalate fibers, 35 parts by weight of cotton fibers, and 15 parts by weight of drawn and crimped brominated aromatic polyester fibers (previously identified) were carded to form a uniform physical admixture and provided in the form of a lightweight plain weave fabric having a weight of 3.0 ounces per yard.

A preferred organophosphorus flame retardant (i.e. a polyphosphonate) was topically applied to the fiber blend. More specifically, the organophosphorus flame retardant was a vinyl phosphonate commercially available from the Stauffer Chemical Company under the designation "Fyrol 76" which had the structural formula

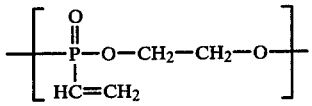

The bath from which the flame retardant was applied was initially formed by mixing 20 parts by weight of the vinyl phosphonate, 20 parts by weight of a 60 percent solution of N-methylolacrylamide, 59.5 parts by weight water, and 0.5 part by weight of potassium persulfate.

The fabric was dipped into the bath solution, and padded through rollers twice for a wet pick-up of 80 percent by weight based upon the weight of the fabric. The fabric was dried in a forced air oven at 225° F. for 5 minutes, and cured at 300° F. for 4 minutes. The vinyl phosphonate was present on the fabric in a concentration of about 16 percent by weight based upon the weight of the fabric. The fabric was next scoured, and then laundered 50 times (140° F. wash) and tumble dried. The fabric possessed desirable textile properties.

Upon testing in the methane diffusion flame (previously described) it was found that the fabric passed the FF 3-71 test and had an average char length of 3.6 inches and an average burn time of about 1.4 second.

EXAMPLE VI

Example V substantially was repeated with the exceptions indicated.

The fabric construction formed from the blend of Example V was a medium weight mock leno having a weight of 5.0 ounces per yard.

The bath from which the flame retardant was applied was initially formed by mixing 10 parts by weight of the vinyl phosphonate, 10 parts by weight of a 60 percent solution of N-methylolacrylamide, 74.5 parts by weight of water, and 0.5 part by weight of potassium persulfate.

The vinyl phosphonate was present on the fabric immediately following curing in a concentration of about 8 percent by weight based upon the weight of the fabric.

Upon testing in the methane diffusion flame (previously described) it was found that the fabric passed the FF 3-71 test and had an average char length of about 4.9 inches and an average burn time of about 6.6 seconds.

EXAMPLE VII

Example V substantially was repeated with the exceptions indicated.

55 parts by weight of drawn crimped polyethylene terephthalate fibers, and 10 parts by weight of cotton fibers, and 10 parts by weight of drawn and crimped brominated aromatic polyester fibers (previously identified) were carded to form a uniform physical admixture and provided in the form of a medium weight twill fabric having a weight of 7.5 ounces per yard.

The bath from which the flame retardant was applied was initially formed by mixing 15 parts by weight of the vinyl phosphonate, 10 parts by weight of a 60 percent solution of N-methylolacrylamide, 74.5 parts by weight of water, and 0.5 part by weight of potassium persulfate.

The wet pick-up was about 70 percent by weight based upon the weight of the fabric. The vinyl phosphate was present on the fabric immediately following curing in a concentration of about 10.5 percent by weight based upon the weight of the fabric.

Upon testing in the methane diffusion flame (previously described) it was found that the fabric passed the FF 3-71 test and had an average char length of about 1.2 inch and an average burn time of about 0.4 second.

EXAMPLE VIII

Example V substantially was repeated with the exceptions indicated.

The organophosphorus flame retardant topically applied to the fiber blend was an organophosphonium salt. More specifically, the organophosphorus flame retardant was tetrakis hydroxymethyl phosphonium chloride which was commercially available from the Hooker Chemical Co. under the designation "THPC".

The bath from which the flame retardant was applied was initially formed by mixing 20 parts by weight of the tetrakis hydroxymethyl phosphonium chloride (80 percent solution), 10 parts by weight sodium hydroxide (20 percent solution), 4 parts by weight urea, 15 parts by weight Aerotex 23 Special trimethylolmelamine, and 51 parts by weight water.

The fabric experienced a wet pick-up of 80 percent by weight based upon the weight of the fabric. The fabric was dried in a forced air oven at 225° F. for 5 minutes, and cured at 330° F. for 3 minutes. The organophosphorus flame retardant was present on the fabric immediately after curing in a concentration of about 12.8 percent by weight based upon the weight of the fabric.

Upon testing in a methane diffusion flame (previously described) it was found that the fabric passed the FF 3-71 test and had an average char length of 3.7 inches and an average burn time of 0.3 second.

EXAMPLE IX

Example V substantially is repeated with the exceptions indicated.

The fabric construction formed from the blend of Example V is a medium weight twill having a weight of 7.5 ounces per yard.

The organophosphorus flame retardant topically applied to the fiber blend is another organophosphonium salt. More specifically, the organophosphorus flame retardant is tetrakis hydroxymethyl phosphonium sulfate which is commercially available from the Hooker Chemical Co. under the designation "Pyroset TKO".

The bath from which the flame retardant is applied is initially formed by mixing 20 parts by weight of the tetrakis hydroxymethyl phosphonium sulfate, 4.8 percent by weight urea, 0.2 parts by weight Triton X-100 surfactant, and 75 parts by weight water.

The fabric experiences a wet pick-up of 80 percent by weight based upon the weight of the fabric. The fabric is dried in an air oven at 225° F. for 3 minutes, cured at 350° F. for 25 minutes, subjected to a hydrogen peroxide afterwash for 20 minutes at 140° F., subjected to an alkaline afterwash (dilute soda ash bath), and is rinsed. The organophosphorus flame retardant is present on the fabric in a concentration of about 16 percent by weight based upon the weight of the fabric.

Upon testing in a methane diffusion flame (previously described) the fabric exhibits characteristics similar to those reported in Example VIII.

Although the invention has been described with preferred embodiments it is to be understood that variations and modifications may be employed without departing from the concept of the invention as defined in the following claims.

We claim:

1. A process for rendering flame retardant an admixture of discrete fibers comprising about 50 to 70 percent by weight polyester fibers which comprise at least 85 mole percent polyethylene terephthalate and about 30 to 50 percent by weight cotton fibers consisting essentially of (a) intimately blending in physical admixture with said polyester and cotton fibers cotton additive fibers of synthetic aromatic polyester polymer containing chlorine, bromine, or mixtures thereof chemically bound to an aromatic ring having a chlorine and/or bromine content of about 25 to 60 percent by weight based upon the weight of said aromatic polymer in a quantity of about 10 to 40 percent by weight based upon the total weight of said fibers of polyester, cotton and synthetic aromatic polyester polymer, with said fibers of synthetic aromatic polymer being substantially free of an oxide of antimony, and (b) applying a topical application of an organophosphorus flame retardant to said resulting fiber blend in a minor concentration of about 2 to 20 percent by weight based upon the total weight of the fibers of polyester, cotton, and synthetic aromatic polymer wherein said fibers are rendered non-burning when subjected to a methane diffusion flame at ambient conditions and exhibit desirable textile properties.

2. A process for rendering flame retardant an admixture of discrete polyester and cotton fibers in accordance with claim 1 wherein said polyester fibers are substantially all polyethylene terephthalate.

3. A process for rendering flame retardant an admixture of polyester and cotton fibers in accordance with claim 1 wherein said admixture of discrete fibers comprises about 65 percent by weight of said polyester fibers and about 35 percent by weight of said cotton fibers.

4. A process for rendering flame retardant an admixture of polyester and cotton fibers in accordance with claim 1 wherein said additive fibers have a chlorine and/or bromine content of about 25 to 50 percent by weight.

5. A process for rendering flame regardant an admixture of polyester and cotton fibers in accordance with claim 1 wherein bromine is chemically bound to an aromatic ring of said discrete additive fibers.

6. A process for rendering flame retardant an admixture of polyester and cotton fibers in accordance with claim 1 wherein chlorine is chemically bound to an aromatic ring of said discrete additive fibers.

7. A process for rendering flame retardant an admixture of polyester and cotton fibers in accordance with claim 1 wherein said blend of fibers is provided in fabric form prior to applying said topical application of an organophosphorus flame retardant in accordance with step (b).

8. A process for rendering non-burning an admixture of polyester and cotton fibers in accordance with claim 1 wherein retardant organophosphorus flame retrdant is a polyphosphonate.

9. A process for rendering flame retardant an admixture of polyester and cotton fibers in accordance with claim 1 wherein said organophosphorus flame retardant is applied to said resulting fiber blend in a minor concentration of about 6 to 16 percent by weight based upon the total weight of the fibers of polyester, cotton, and synthetic aromatic polyester polymer.

10. A process for rendering flame retardant an admixture of discrete fibers comprising about 50 to 70 percent by weight polyester fibers which comprise at least 85 mole percent polyethylene terephthalate and about 30 to 50 percent by weight cotton fibers consisting essentially of:

(a) intimately blending in physical admixture with said polyester and cotton fibers discrete additive fibers of a halogenated aromatic polyester of the recurring structural formula:

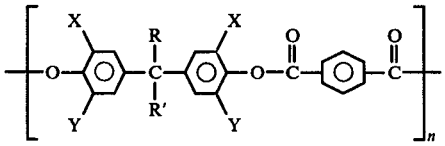

where X is chlorine or bromine, Y is hydrogen, chlorine or bromine, R and R' may be the same or different and represent lower alkyl groups, hydrogen, or together constitute a cyclic hydrocarbon group, and n = at least 25, in a quantity of about 10 to 40 percent by weight based upon the total weight of said fibers of polyester, cotton and halogenated aromatic polyester, with said fibers of said halogenated aromatic polyester being substantially free of an oxide of antimony, and (b) applying a topical application of an organophosphorus flame retardant to said fiber blend in a minor concentration of about 2 to 15 percent by weight based upon the total weight of the fibers of polyester, cotton, and halogenated aromatic polyester wherein said resulting fibers are rendered non-burning when subjected to a methane diffusion flame at ambient conditions and exhibit desirable textile properties.

11. A process for rendering flame retardant an admixture of discrete polyester and cotton fibers in accordance with claim 10 wherein said polyester fibers are substantially all polyethylene terephthalate.

12. A process for rendering flame retardant an admixture of polyester and cotton fibers in accordance with claim 10 wherein said admixture of discrete fibers comprises about 65 percent by weight of said polyester fibers and about 35 percent by weight of said cotton fibers.

13. A process for rendering flame retardant an admixture of polyester and cotton fibers in accordance with claim 10 wherein X and Y are of said halogenated aromatic polyester are bromine.

14. A process for rendering flame retardant an admixture of polyester and cotton fibers in accordance with claim 10 wherein said fibers of halogenated aromatic polyester are formed by the reaction of tetrabromobisphenol A, isophthalic acid, and terephthalic acid or the ester-forming derivatives thereof.

15. A process for rendering flame retardant an admixture of polyester and cotton fibers in accordance with claim 10 wherein said fibers of halogenated aromatic polyester are formed by the reaction of tetrabromobisphenol A and a mixture of about 45 to 75 percent by weight of isophthaloyl chloride and about 55 to 25 percent by weight terephthaloyl chloride.

16. A process for rendering flame retardant an admixture of polyester and coton fibers in accordance with claim 10 wherein said blend of fibers is provided in fabric form prior to applying said topical application of organophosphorus flame retardant in accordance with step (b).

17. A process for rendering flame retardant an admixture of polyester and cotton fibers in accordance with claim 10 wherein said organophosphorus flame retardant is a polyphosphonate.

18. A process for rendering flame retardant an admixture of polyester and cotton fibers in accordance with claim 10 wherein said organophosphorus flame retardant is applied to said resulting fiber blend in a minor concentration of about 6 to 16 percent by weight based upon the total weight of the fibers of polyester, cotton, and halogenated aromatic polyester.

19. A process for rendering flame retardant an admixture of discrete fibers comprising about 50 to 70 percent by weight polyester fibers which comprise at least 85 mole percent polyethylene terephthalate and about 30 to 50 percent by weight cotton fibers consisting essentially of:

(a) intimately blending in physical admixture with said polyester and cotton fibers discrete additive fibers of a brominated aromatic polyester formed by the reaction of tetrabromobisphenol A and a mixture of 45 to 75 percent by weight isophthaloyl chloride and about 55 to 25 percent by weight terephthaloyl chloride, in a quantity of about 10 to 40 percent by weight based upon the total weight of said fibers of polyester, cotton and brominated aromatic polyester, with said fibers of brominated aromatic polyester being substantially free of an oxide of antimony, (b) forming said resulting blend in the form of a fabric, and (c) applying a topical application of an organophosphorus flame retardant to said fabric in a minor concentration of about 2 to 20 percent by weight based upon the total weight of said fabric wherein said fabric is non-burning when subjected to a methane diffusion flame at ambient conditions and exhibits desirable textile properties.

20. A process for rendering flame retardant an admixture of discrete polyester and cotton fibers in accordance with claim 19 wherein said polyester fibers are substantially all polyethylene terephthalate.

21. A process for rendering flame retardant an admixture of polyester and cotton fibers in accordance with claim 19 wherein said admixture of discrete fibers comprises about 65 percent by weight of said polyester fibers and about 35 percent by weight of said cotton fibers.

22. A process for rendering flame retardant an admixture of polyester and cotton fibers in accordance with claim 19 wherein said organophosphorus flame retardant is a polyphosphonate.

23. A process for rendering flame retardant an admixture of polyester and cotton fibers in accordance with claim 19 wherein said organophosphorus flame retardant is applied to said resulting fiber blend in a minor concentration of about 6 to 16 percent by weight based upon the total weight of the fibers of polyester, cotton, and brominated aromatic polyester.

24. A flame retardant admixture of discrete fibers possessing desirable textile properties which is non-burning when subjected to a methane diffusion flame at ambient conditions comprising:

(a) about 35 to 55 percent by weight of polyester fibers which comprise at least 85 mole percent polyethylene terephthalate.

(b) about 20 to 40 percent by weight of cotton fibers, and (c) about 10 to 40 percent by weight of synthetic aromatic polyester polymer fibers containing chlorine, bromine, or mixtures thereof chemically bound to an aromatic ring having a chlorine and/or bromine content of about 25 to 60 percent by weight based upon the weight of said synthetic aromatic polyester polymer which are substantially free of an oxide of antimony, wherein said admixture bears a topically applied organophosphorus flame retardant in a concentration of about 2 to 20 percent by weight based upon the weight of said fiber admixture absent said organophosphorus flame retardant.

25. A flame retardant admixture of discrete fibers in accordance with claim 24 wherein said polyester fibers of component (a) are substantially all polyethylene terephthalate.

26. A flame retardant admixture of discrete fibers in accordance with claim 24 wherein the fibers of component (c) have bromine chemically bound to an aromatic ring.

27. A flame retardant admixture of discrete fibers in accordance with claim 24 wherein the fibers of component (c) have chlorine chemically bound to an aromatic ring.

28. A flame retardant admixture of discrete fibers in accordance with claim 24 wherein said organophosphorus flame retardant is a polyphosphonate.

29. A flame retardant admixture of discrete fibers in accordance with claim 24 wherein said organophosphorous flame retardant is applied to said admixture in a minor concentration of about 6 to 16 percent by weight based upon the total weight of the fibers of polyester, cotton, and synthetic aromatic polyester polymer.

30. A flame retardant admixture of discrete fibers in accordance with claim 24 which is present in the form of a fabric.

31. A flame retardant admixture of discrete fibers possessing desirable textile properties which is non-burning when subjected to a methane diffusion flame at ambient conditions comprising:

(a) about 35 to 55 percent by weight of polyester fibers which comprise at least 85 mole percent polyethylene terephthalate, (b) about 20 to 40 percent by weight cotton fibers, and (c) about 10 to 40 percent by weight of fibers of halogenated aromatic polyester of the recurring structural formula:

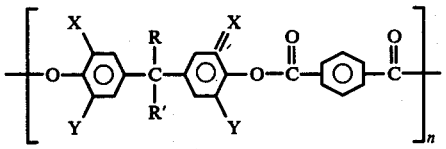

where X is chlorine or bromine, Y is hydrogen, chlorine or bromine, R and R' may be the same or different and represent lower alkyl groups, hydrogen, or together constitute a cyclic hydrocarbon group, and n= at least 25, which are substantially free of an oxide of antimony, wherein said admixture bears a topically applied organophosphorus flame retardant and a concentration of about 2 to 20 percent by weight based upon the weight of said fiber admixture absent said organophosphorus flame retardant.

32. A flame retardant admixture of discrete fibers in accordance with claim 31 wherein said polyester fibers of component (a) are substantially all polyethylene terephthalate.

33. A flame retardant admixture of discrete fibers in accordance with claim 31 wherein the fibers of component (c) have bromine chemically bound to an aromatic ring.

34. A flame retardant admixture of discrete fibers in accordance with claim 31 wherein the fibers of component (c) have chlorine chemically bound to an aromatic ring.

35. A flame retardant admixture of discrete fibers in accordance with claim 31 wherein said organophosphorus flame retardant is a polyphosphonate.

36. A flame retardant admixture of discrete fibers in accordance with claim 31 wherein said organophosphorus flame retardant is applied to said admixture in a minor concentration of about 6 to 16 percent by weight based upon the total weight of the fibers of polyester, cotton, and halogenated aromatic polyester.

37. A flame retardant admixture of discrete fibers in accordance with claim 31 wherein fiber component (a) comprises about 40 to 50 percent by weight, fiber component (b) comprises about 25 to 35 percent by weight, and fiber component (c) comprises about 15 to 30 percent by weight.

38. A flame retardant admixture of discrete fibers in accordance with claim 31 which is present in the form of a fabric.

39. A flame retardant admixture of discrete fibers in fabric form possessing desirable textile properties which is non-burning when subjected to a methane diffusion flame at ambient conditions comprising:

(a) about 35 to 55 percent by weight of polyester fibers which comprise at least 85 mole percent of polyethylene terephthalate, (b) about 20 to 40 percent by weight of cotton fibers, and (c) about 10 to 40 percent by weight of brominated polyester fibers formed by the reaction of tetrabromobisphenol A and a mixture of 45 to 75 percent by weight isophthaloyl chloride and about 55 to 25 percent by weight of terephthaloyl chloride, which are substantially free of an oxide of antimony, wherein said admixture in fabric form bears a topically applied organophosphorus flame retardant in a concentration of about 2 to 20 percent by weight based upon the weight of the fiber admixture absent said organophosphorus flame retardant.

40. A flame retardant admixture of discrete fibers in fabric form in accordance with claim 39 wherein the polyester fibers of component (a) are substantially all polyethylene terephthalate.

41. A flame retardant admixture of discrete fibers in fabric form in accordance with claim 39 wherein fiber component (c) is formed by the reaction of tetrabromobisphenol A and a mixture of about 60 mole percent isophthaloyl chloride, and about 40 mole percent terephthaloyl chloride.

42. A flame retardant admixture of discrete fibers in fabric form in accordance with claim 39 wherein fiber component (a) comprises about 40 to 50 percent by weight, fiber component (b) comprises about 25 to 35 percent by weight, and fiber component (c) comprises about 15 to 30 percent by weight.

43. A flame retardant admixture of discrete fibers in fabric form in accordance with claim 39 wherein said fabric is a woven fabric.

44. A flame retardant admixture of discrete fibers in fabric form in accordance with claim 39 wherein said fabric is a knitted fabric.

45. A flame retardant admixture of discrete fibers in accordance with claim 39 wherein said organophosphorus flame retardant is applied to said admixture in a minor concentration of about 6 to 16 percent by weight based upon the total weight of the fibers of polyester, cotton, and brominated polyester.

46. A flame retardant admixture of discrete fibers in accordance with claim 45 wherein said organophosphorus flame retardant is a polyphosphonate.

47. A flame retardant admixture of discrete fibers in accordance with claim 46 wherein said polyphosphonate flame retardant is a vinyl phosphonate.

* * * * *